US005732309A

United States Patent [19]

Okuno et al.

[11] Patent Number: 5,732,309

[45] Date of Patent: Mar. 24, 1998

[54] IMAGE FORMING APPARATUS

[75] Inventors: Jinju Okuno, Toyohashi; Masanori Yamamoto, Toyokawa, both of Japan

[73] Assignee: Minolta Co., Ltd., Osaka, Japan

[21] Appl. No.: 802,865

[22] Filed: Feb. 19, 1997

[30] Foreign Application Priority Data

Feb. 20, 1996 [JP] Japan ..... 8-032083
Mar. 27, 1996 [JP] Japan ..... 8-072802

[51] Int. Cl.[6] ..... G03G 15/20

[52] U.S. Cl. ..... 399/68; 399/33; 399/67; 399/320; 399/322

[58] Field of Search ..... 399/9, 33, 67, 399/68, 69, 320, 322, 328, 335, 400

[56] References Cited

U.S. PATENT DOCUMENTS

| | | | |
|---|---|---|---|
| 3,778,222 | 12/1973 | Suzuki | 399/33 X |
| 3,809,475 | 5/1974 | Post et al. | 399/33 |
| 4,348,102 | 9/1982 | Sessink | 399/68 |
| 5,032,874 | 7/1991 | Matsuuchi | 399/33 |
| 5,087,947 | 2/1992 | Torino | 399/322 |
| 5,448,339 | 9/1995 | Kokaji et al. | 399/69 |
| 5,633,704 | 5/1997 | Suzuki et al. | 399/69 |

FOREIGN PATENT DOCUMENTS 64-49073 2/1989 Japan .

*Primary Examiner*—Sandra L. Brase
*Attorney, Agent, or Firm*—Burns, Doane, Swecker & Mathis, LLP

[57] ABSTRACT

This invention concerns an image forming apparatus provided with a fixing device for fixing an image formed on a sheet. This apparatus comprises shutters for shielding opening parts formed in the fixing device for the passage of the sheet, a driver for switching the shutters between the opened state and the closed state, a sensor for detecting the presence or absence of the opened state of the shutters, and a CPU for setting the driver moving and controlling the opening or closing motion of the shutters. The CPU compares the signal to open or close the shutters and the signal from the sensor and prohibits the fixing device from producing a fixing motion when the sensor detects the closed state of the shutters in spite of the issuance of a signal to open the shutters. Owing to this construction, the otherwise possible blockage of the sheet by the shutters provided for the fixing device can be precluded because the fixing operation of the fixing device is prohibited when the shutters are closed in spite of the issuance of the signal to open the shutters.

12 Claims, 19 Drawing Sheets

IMAGE FORMING APPARATUS

BACKGROUND OF THE INVENTION

1. Field of the Invention

This invention relates to such an electrophotographic image forming apparatus as the copying machine, the printer, or the facsimile system which is provided with a fixing device for fixing an image formed on a sheet.

2. Description of the Prior Art

The desirability of manufacturing commodities realizing the conservation of energy has been finding enthusiastic recognition in recent years. Also in the market of image forming apparatuses including copying machines, printers, and facsimile systems, the conservation of energy has been constituting itself an important consideration.

Among these image forming apparatuses, the copying machines which utilize the electrophotographic principle in most cases adopt a fixing process resorting to a thermal roller which is kept hot with a heater. About 80% of the energy consumed by the copying machine is spent by the fixing device which implements this fixing process.

In the fixing device of this kind, the roller is always kept hot by the heater so that the surface temperature of the roller may be retained in a range necessary for the fixation. The energy supplied to the heater, therefore, increases in proportion as the amount of the heat emanating from the fixing device grows. Thus, the effect of the energy conservation can be exalted by decreasing the amount of the heat (loss of energy) emanating from the fixing device.

JP-A-64-49073, for example, has proposed a fixing device which, with due respect to the fact that about 40% of the loss of energy suffered by the fixing device is accounted for by the escape of heat through convection from the fixing device, attains prevention of the emanation of heat from the fixing device to the fullest possible extent by wholly enclosing the fixing device with a cover and providing opening parts for the passage of a sheet (an inlet and an outlet for the sheet) each with a shutter adapted to open during the passage of the sheet and close during the absence of the passage of the sheet.

The fixing device which has shutters provided one each at the inlet and the outlet for the passage of the sheet as described above, however, encounters the following problems.

The first problem is that when the mechanism for opening and closing the shutters develops a mechanical trouble and the sheet outlet and inlet of the fixing device are consequently closed, the sheet conveyed in consequence of an action of copying or printing to the fixing device is stuck.

The second problem is that the chance of executing the action of copying or printing is missed notwithstanding this action is actually attainable because the action is prohibited while the sheet inlet and outlet of the fixing device are in an opened state and the fixing operation itself is attainable in spite of a mechanical trouble of the mechanism for opening and closing the shutters.

The third problem is that when the action of copying or printing is performed on a plurality of sheets, the opening and closing motions of the shutters are so frequent as to form the sources of vibration or noise and the vibration of this nature is propagated to not only the fixing process but also the other processes of electrophotography and is in a worse case suffered to induce disfigurement of a copied or printed image and, especially in a machine operated at a high speed, the vibration is so serious as to aggravate the disfigurement of the image possibly to a hardly ignorable extent.

SUMMARY OF THE INVENTION

An object of this invention is to provide an image forming apparatus furnished with a fixing device which is possessed of shutters adapted to prevent a sheet from being stuck owing to a mechanical trouble in the mechanism for opening and closing the shutters and enable the fixing device to execute its operation and allow such an image forming operation as copying or printing to proceed infallibly so long as the shutters are in an opened state in spite of a mechanical trouble in the mechanism for opening and closing the shutters.

Another object of this invention is to provide an image forming apparatus fitted with a fixing device which is possessed of shutters adapted to preclude the vibration due to the opening and closing motions of the shutters from producing an adverse effect on an image being formed.

This invention is directed to an image forming apparatus provided with a fixing device for fixing an image formed on a sheet, which apparatus comprises shutters for shielding opening parts formed in the fixing device for the passage of the sheet, a driver for switching the shutters between the opened state and the closed state, a sensor for detecting the presence or absence of the opened state of the shutters, control means to set the driver moving and control the opening or closing motion of the shutters, and prohibiting means to compare the signal from the control means and the signal from the sensor and prohibit the fixing device from producing a fixing motion when the sensor detects the closed state of the shutters notwithstanding the control means has issued a signal to open the shutters.

The blockage of the sheet by the shutters provided for the fixing device, therefore, can be prevented because the fixing device is prohibited from producing the fixing motion when the shutters remain in the closed state notwithstanding the control means has issued the signal to open the shutters.

This invention is further directed to a fixing device comprising shutters for shielding opening parts formed in the fixing device for the passage of a sheet, a driver for switching the shutters between the opened state and the closed state, a sensor for detecting the presence or absence of the opened state of the shutters, control means to set the driver moving and control the opening or closing motion of the shutters, and fixing motion controlling means to compare the signal from the control means and the signal from the sensor and prohibit start of a fixing motion of the fixing device when the sensor detects the closed state of the shutters notwithstanding the control means has issued a signal to open the shutters and, in contrast, allows the start of the fixing motion of the fixing device when the sensor detects the opened state of the shutters notwithstanding the control means has issued a signal to close the shutters.

The blockage of the sheet due to a mechanical trouble in the mechanism for opening and closing the shutters can be prevented because the fixing motion is prohibited when the shutters are in the closed state notwithstanding the control means has issued the signal to open the shutters or the fixing motion is allowed when the shutters are in the opened state notwithstanding the control means has issued the signal to close the shutters and, at the same time, the efficiency of utilization of the fixing device can be exalted because the fixing device can produce the motion thereof so long as the shutters are in the opened state in spite of the mechanical trouble of the mechanism for opening and closing the shutters.

This invention is further directed to an image forming apparatus provided with a fixing device for fixing an image formed on a sheet, which apparatus comprises shutters for shielding opening parts formed in the fixing device for the passage of the sheet, a driver for switching the shutters between the opened state and the closed state, a sensor for detecting the presence or absence of the opened state of the shutters, and control means to set the driver moving and control the opening or closing motion of the shutters, the control means effect lug the control of the shutters during continuous formation of an image on a plurality of sheets in such a manner that the shutters may be kept open between the time the first sheet is passed therethrough and the time the last sheet is discharged therefrom.

Since the shutters avoid producing the opening and closing motions thereof during the continuous formation of an image on a plurality of sheets, therefore, the possibility of the opening and closing motions of the shutters producing an adverse effect thereof on the images being continuously produced can be eliminated.

This invention is further directed to an image forming apparatus provided with a fixing device for fixing an image formed on a sheet, which apparatus comprises shutters for shielding opening parts formed in the fixing device for the passage of the sheet, a driver for switching the shutters between the opened state and the closed state, a sensor for detecting the presence or absence of the opened state of the shutters, conveying means to convey the sheet, a counter for taking count of the number of sheets conveyed by the conveying means, setting means to set the number of sheets on which the image is expected to be formed, and control means to set the driver operating and control the opening and closing motions of the shutters, the control means effecting the control of the driver during the continuous formation of an image on a plurality of sheets in such a manner that the shutters may be opened when the image forming operation is started and the shutters may be closed after the counter has counted up the preset number of sheets.

Since the shutters avoid producing the opening and closing motions thereof during the continuous formation of an image on a plurality of sheets and until the fixation of the image has been completed on a preset number of sheets, therefore, the possibility of the opening and closing motions of the shutters producing an adverse effect thereof on the images being continuously produced can be eliminated.

DETAILED DESCRIPTION OF THE INVENTION

Now, the present invention will be described below with reference to the diagrams attached hereto. In the following description, the term "ON edge" is to be construed as referring to the change of state which occurs when switches, sensors, signals, etc. are switched from the OFF to the ON state and the term "OFF edge" by the same token construed as referring to the change of state which occurs when the switches, sensors, signals, etc. are switched from the ON to the OFF state.

EXAMPLE 1

Figure 1:
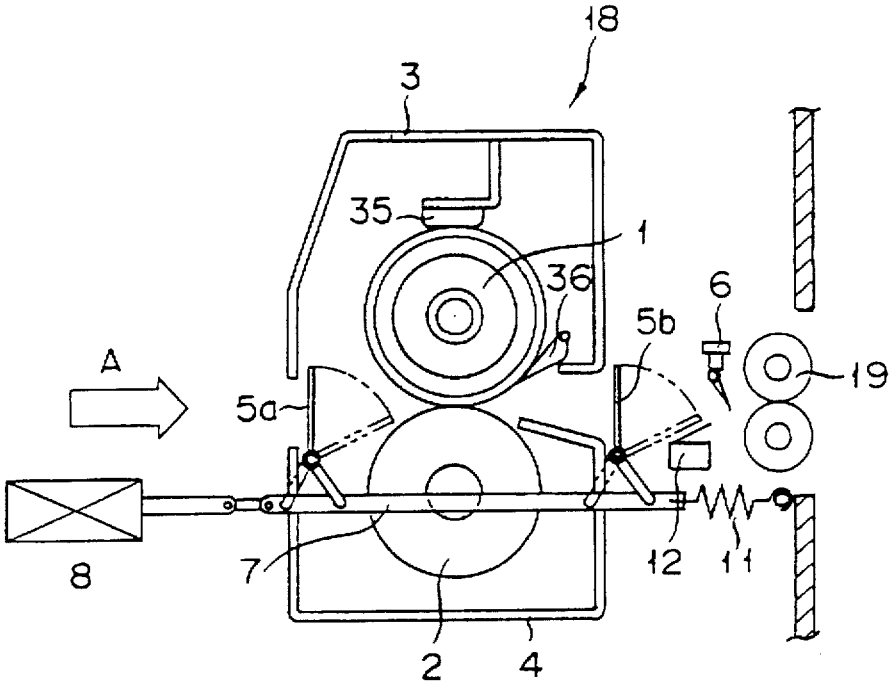
FIG. 1 is a schematic diagram of a fixing device provided with shutters according to this invention.
Figure 2:
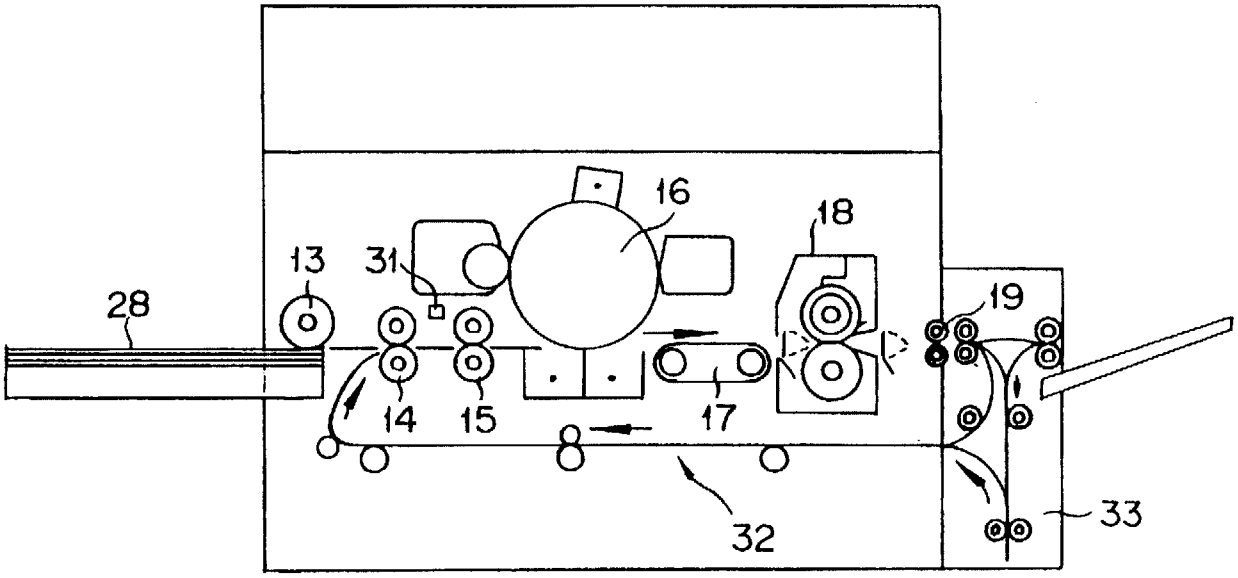
FIG. 2 is a schematic diagram illustrating the construction of a copying machine.
Figure 3:
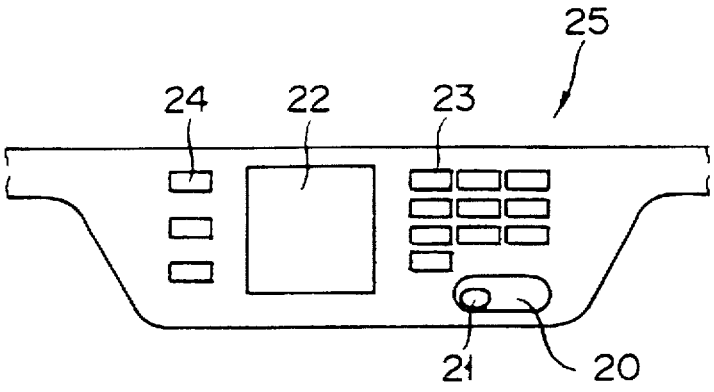
FIG. 3 is a diagram illustrating an operating panel of the copying machine.
Figure 4:
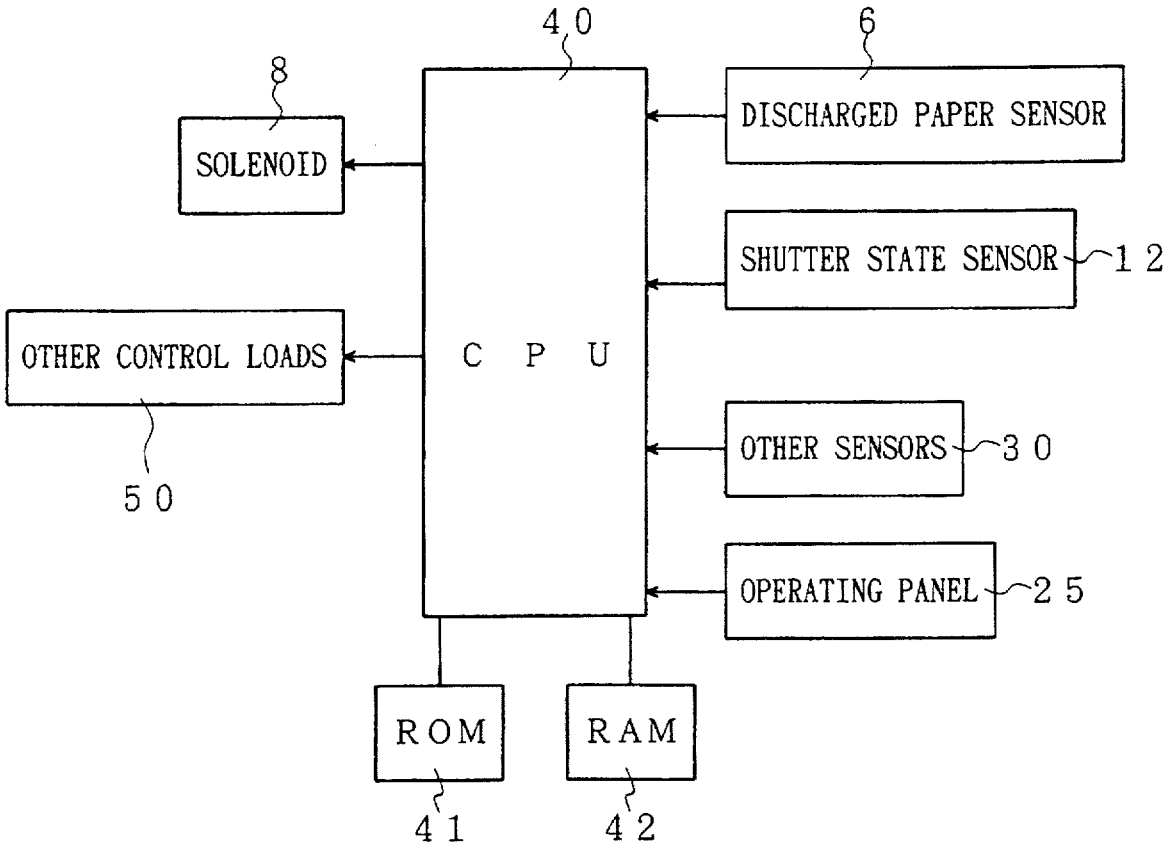
FIG. 4 is a block diagram of a control system of the copying machine.

FIG. 1 is a schematic diagram of a fixing device embodying this invention, FIG. 2 is a schematic diagram illustrating the image forming apparatus part as a principal component of a copying machine using the fixing device, FIG. 3 is a diagram illustrating one example of an operating panel provided on the upper surface of the copying machine, and FIG. 4 is a block diagram to aid in the description of a control system of the copying machine.

In a fixing device 18 illustrated in FIG. 1, a heating roller 1 and a pressing roller 2 are encased respectively with an upper cover 3 and a lower cover 4 and opening parts (inlet and outlet) for the passage of a sheet are provided between the covers 3 and 4. In these opening parts shutters 5*a* and 5*b* which interlock with each other are provided. These shutters 5*a*, 5*b* are connected to a moving member 7 disposed at a position lower than the path for the conveyance of the sheet. The moving member 7 is actuated by one solenoid 8 to impart opening and closing motions to the shutters 5*a*, 5*b*. When the shutters consequently assume an open state, the shutter 5*a* opens toward the inside of the fixing device 18 and the shutter 5*b* opens toward the outside thereof and they severally serve concurrently as guides for the conveyance of the sheet. An arrow bearing a symbol A in the diagram represents the direction of conveyance of the sheet.

The moving member 7 and the solenoid 8 constitute a driver for opening and closing the shutters 5*a*, 5*b* as described above. The moving member 7 has one end thereof connected to the solenoid 8 and the other end thereof connected to a spring member 11 which is fixed as to a frame of the copying machine. The shutters 5*a*, 5*b* are closed when the moving member 7 assumes a state drawn by the spring member 11 and the shutters 5*a*, 5*b* are opened when the moving member 7 assumes a state drawn by the solenoid 8 in the direction of the left in the bearings of the diagram.

The opened or the closed state of the shutters is detected by a shutter state sensor 12. Such means as the limit switch or the photo interrupter, for example, is used as the shutter state sensor 12. Since the shutters 5*a*, 5*b* are interlocked in this device, the limit switch may be disposed below the outside of the shutter 5*b* and enabled to detect the opened or the closed state of the shutters.

The heating roller 1 in the fixing device 18 is kept hot by a heat source (not shown) and rotated by a motor and a rotating mechanism (both omitted from illustration). A loose toner image formed on the sheet is fixed as the sheet is passed through the gap (nip part) between the heating roller 1 and the pressing roller 2 which is pressed against the heating roller 1 and caused to follow the rotation of the heating roller 1. The heating roller 1 is provided on the periphery thereof with a temperature sensor 35 for detecting the fixing temperature and controlled thereby at a temperature necessary for the fixation of the toner image. The heating roller 1 is further provided on the periphery thereof with a claw member 36 for separating the sheet from the heating roller 1. In addition, a discharged paper sensor 6 and paper discharging rollers 19 are provided on the downstream side of the fixing device 18 in the direction of conveyance of the sheet.

The covers 3 and 4 and the shutters 5*a* and 5*b* herein are formed as of stainless steel, for example. Preferably, they are further covered with a heat insulator and prevented thereby from allowing ready escape of the internal heat.

A copying machine illustrated in FIG. 2 is possessed of a standard image forming apparatus. As respects the fundamental operation, this copying machine initiates a copying motion when a copy start switch 20 on an operating panel 25 illustrated in FIG. 3 is depressed. As a result, the sheet is fed out of a cassette 28 by the rotation of a pickup roller 13, passed through riffling rollers 14, and stopped by timing rollers 15 and made to assume a brief waiting state. In the meanwhile, an original document to be copied is read out by an image reading device (not shown) provided on the copying machine and an electrostatic latent image is formed consequently on a photosensitive member 16. The electrostatic latent image formed on the photosensitive member 16 is transferred in the form of a loose toner image onto the sheet which is fed from the timing rollers 15 as synchronized with the timing of transfer. The sheet after the step of this transfer is forwarded by a suction belt 17 into the fixing device 18, with the result that the loose toner image is fixed on the sheet. The sheet on which the image has been fixed is discharged by the paper discharging rollers 19 to complete the copying motion.

This copying machine is provided near the timing rollers 15 with a timing sensor 31 which detects the arrival of the sheet at the timing rollers 15.

Further, this copying machine is provided, for the sake of effecting double-face copying, with an inverting device 33 for provisionally retaining the sheet discharged from the paper discharging rollers 19 and reversing the sheet and a double-face conveying path 32 for returning the reversed sheet to the timing rollers 15.

The commands for producing these copying motions are issued from the operating panel 25 illustrated in FIG. 3. On this operating panel 25 are provided the copy start button 20 for indicating the execution of a copying motion and a copy status display lamp 21 for indicating whether or not the copying machine is ready for copying. When the copying machine is engaging in a copying motion or is in a copy prohibiting mode which refuses a copying motion as by reason of a mechanical trouble, the copy status display lamp 21 displays the copy prohibiting mode. During the presence of this mode, no copying motion is initiated even by the depression of the copy start button 20. The copying motion is carried out as described above when the copy start button 20 is depressed after the copy status display lamp 21 has displayed a copy allowing mode. On the operating panel 25 are provided a display panel 22 for displaying various messages, a ten key unit 23 for setting the number of sheets for copying, and function keys 24 for designating such types of copy as multiplied copy and double-face copy besides the start button 20 and the copy status display lamp 21.

FIG. 4 is a block diagram of a control system for effecting the control of this whole copying machine. A CPU (central processing unit) 40 effects the control of the whole copying machine and a RAM 42 for storing control information and a ROM 42 for memorizing a control program and control data are connected to the CPU 40. To the CPU 40, the detection signals from the discharged paper sensor 6, the shutter state sensor 12, and other sensors 30 (such as, for example, the temperature sensor 35) provided in the copying machine and the input signals from the input keys (such as, for example, the copy start button 20 and the ten key unit 23) provided on the operating panel 25 are introduced through the medium of input interfaces (not shown). Meanwhile, from the CPU 40, the signals for controlling the solenoid 8 for opening and closing the shutters and the control loads 50 in the copying machine (various components for the image forming operation such as, for example, the fixing device 18, the image reading device, the photosensitive member 16, and rollers in the conveying path) are emitted through the medium of output interfaces (not shown). The CPU 40 incorporates therein counters and timers for performing such count treatments and timer treatments as produce a copying motion and shutter opening and closing motions which will be described more specifically hereinbelow.

Figure 5:
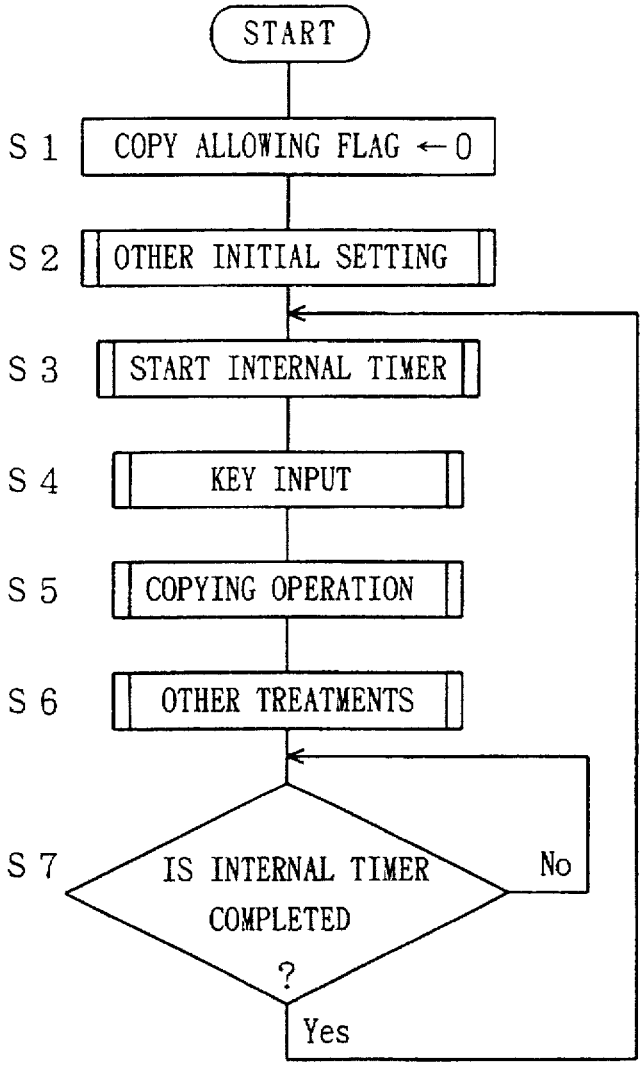
FIG. 5 is a flow chart of a main routine to aid in the description of the control in Example 1.

FIG. 5 is a flow chart of a main routine for the control of the copying machine.

As respects the copying operation, when the main switch (not shown) is depressed to connect the copying machine to the power source, Step S1 sets a copy allowing flag at "0" (status of copy permission) and Step S2 initializes various other contents of control of the copying machine. Step S3 starts the internal timer of the CPU 40 and causes the control from Step S4 onward to be carried out within the length of time set by the internal timer.

Step S4 receives the information introduced by means of the keys on the operating panel 25 and displays necessary information on the display panel 22 and the copy status display lamp 21 on the operating panel 25. Step S5 controls the copying motion in accordance with the contents of control set at Step S4. Step S6 implements such other control than the control executed at Step S5 as, for example, that for the adjustment of temperature of the fixing device.

Then, Step S7 judges whether or not the internal timer has been terminated. When the judgment draws an affirmative answer, the process returns to Step S3, which starts the internal timer again.

Figure 6:
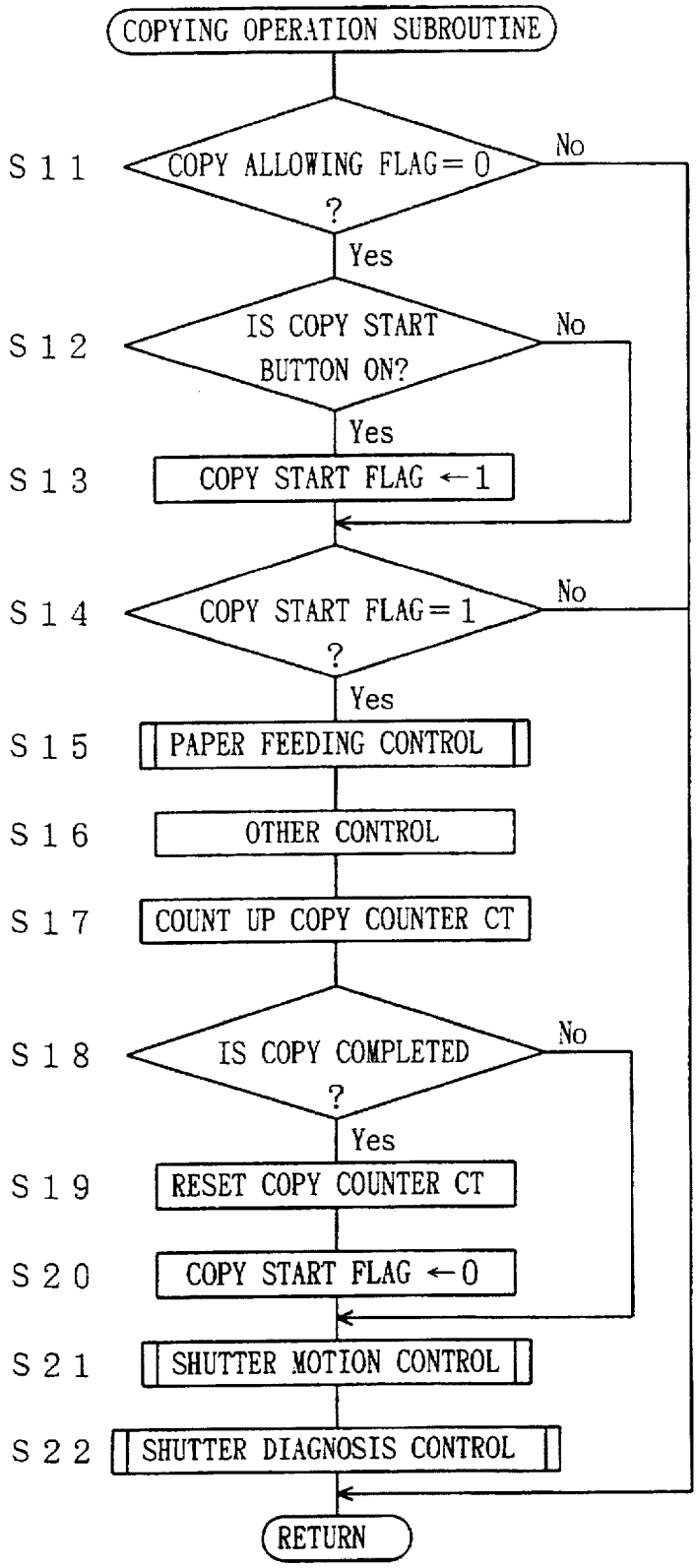
FIG. 6 is a flow chart of a copying operation subroutine shown in FIG. 5 above.

FIG. 6 is a flow chart illustrating the procedure of control of the copying operation subroutine of Step S5 mentioned above. First, Step S11 judges the status of the copy allowing flag. When the status is found to be "0," namely the status for allowing a copying motion, the steps from Step S12 onward are executed. When it is found to be "1," namely the status for prohibiting a copying motion, the process returns to the main routine.

Step S12 judges whether or not the copy start button 20 has been turned ON. When the detection of an ON edge is confirmed, Step S13 sets the copy start flag at "1." When the detection of an ON edge is not confirmed, the process proceeds to Step S14 without executing Step S13.

Step S14 judges whether or not the copy start flag is set at "1." The steps from Step S15 onward are executed when the copy start flag is set at "1." The process returns to the main routine when the copy start flag is not set at "1."

Step S15 implements the control of the system for feeding and conveying the sheet and Step S16 executes other control such as, for example, that on the image reading device and the photosensitive member.

Step S17 adds 1 to the copy counter CT each time the copying motion is completed on one sheet and causes the RAM 42 connected to the CPU 40 to memorize the accumulated number of sheets used for copying.

Step S18 compares the number counted up in the copy counter CT with the number set on the operating panel 25 to judge whether or not the copying motion is completed. When the copying motion has not been completed, the process proceeds to Step S21 without executing Step S19 and Step S20. When the copying motion has been completed on a prescribed number of sheets, the process proceeds to Step S19 which resets the copy counter CT, then to Step S20 which sets the copy start flag at "0," and to Step S21.

Step S21 executes the shutter motion control subroutine which will be specifically described hereinbelow and then proceeds to Step S22. Step S22 implements the shutter diagnosis control subroutine which will be specifically described hereinbelow and returns to the main routine.

Figure 7:
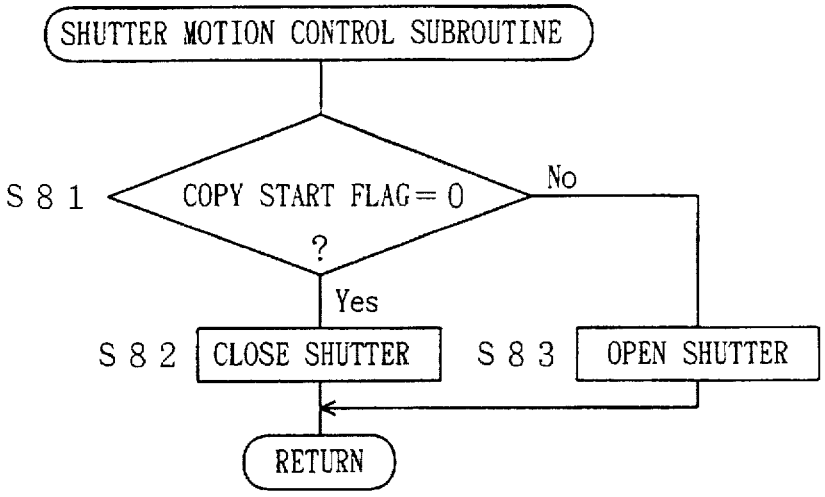
FIG. 7 is a flow chart of a shutter motion control subroutine shown in FIG. 5 above.

FIG. 7 is a flow chart illustrating the procedure of control of the shutter motion control subroutine of Step S21. First, Step S81 judges whether or not the copy start flag is set at "0." When the copy start flag is set at "0," namely when the copying motion is not executed, the process proceeds to Step S82 and stops the solenoid 8, when it is in motion, to close the shutters. In contrast, when the copy start flag is set at "1," namely when the copying motion is executed, the process proceeds to Step S83 and sets the solenoid 8 operating to open the shutters. These shutter motions are carried out while the operations of Step S15 and Step S16 on the paper feeding device and the photosensitive member mentioned above are still in process, namely before the loose toner image has been formed on the sheet.

Figure 8:
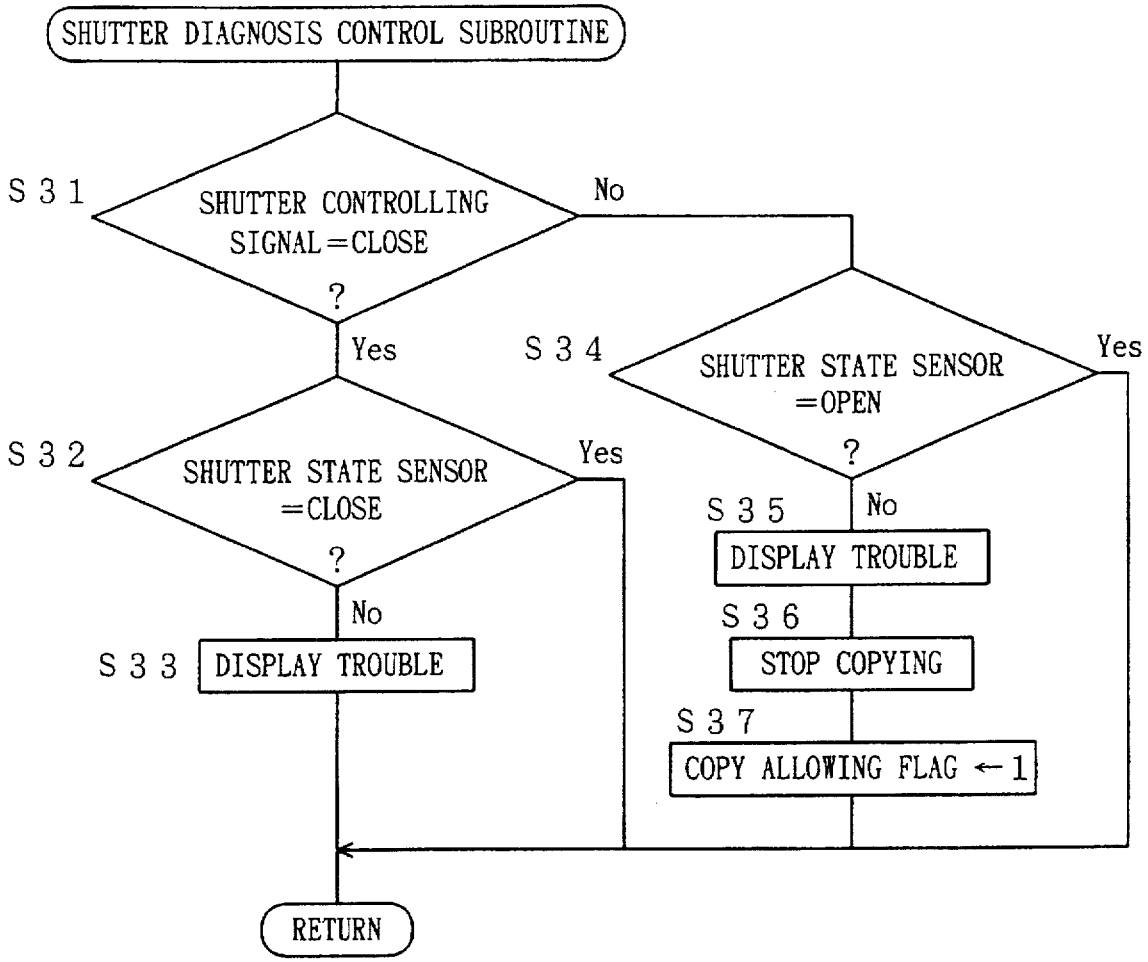
FIG. 8 is a flow chart of a shutter diagnosis control subroutine shown in FIG. 5 above.

FIG. 8 is a flow chart illustrating the procedure of control of the shutter diagnosis control subroutine of Step S22 mentioned above. This subroutine detects the status of mechanical trouble, if any, in the shutters engaging in the copying motion and controls the termination or prohibition of the copying motion in conformity to the detected status of mechanical trouble.

First, Step S31 detects the control signal (shutter controlling signal) issued to the solenoid 8 serving the purpose of opening or closing the shutters and judges whether the solenoid 8 is in the state of opening the shutters or in the state of closing them as the control. When the signal is judged to be that for closing the shutters, Step S32 and Step S33 are executed. When the signal is judged to be that for opening the shutters, the steps from Step S34 onward are executed.

When Step S31 has found the signal to be that for closing the shutters, then Step S32 judges whether or not the shutters have been actually closed by the signal from the shutter state sensor 12. When the shutters are found to be in the closed state and, therefore, the absence of a mechanical trouble is confirmed, the process returns to the copying operation subroutine. When the shutters are found to be in the opened state, Step S33 judges the presence of a mechanical trouble because of the discrepancy between the shutter controlling signal for opening or closing the shutters and the actual state of the shutters and displays a trouble in the display panel 22. When the shutters are found to be in the opened state, since the normal copying motion can be carried out, the process is returned to the copying operation subroutine without stopping or prohibiting the copying motion.

When the shutter controlling signal indicates an opening motion at Step S31 mentioned above, Step S34 judges whether or not the shutters have been actually opened by the signal from the shutter state sensor 12. When the shutters are found to be in an opened state and consequently the absence of a trouble is confirmed, the process returns to the copying operation subroutine. In contrast, when the shutters are found to be in a closed state and the discrepancy between the shutter controlling signal and the actual status of shutters indicates the presence of a trouble, the steps from Step S35 onward are executed.

Step S35 displays a trouble on the display panel 22 and Step S36 stops all the motions of the fixing device, the image reading device, the conveyance device, and so on. Then, Step S37 sets the copy allowing flag at "1," namely the status of copy prohibition, and returns the process to the copying operation subroutine. By setting the copy allowing flag at "1," the copy status display lamp 21 is caused to display a copy prohibition. Then, the status of copy prohibition begins and prevents start of a copying motion. This copy allowing flag is turned to "0" after the shutters are repaired and then initialized (Step S1) by renewing a power source connection.

The detection of a trouble of the shutters and the control effected to deal with the trouble in Example 1 have been described. When a trouble is detected during the status of a copying motion and the shutters remain in a closed state in spite of the issuance of a signal to open the shutters, therefore, the copying motion is stopped, the presence of the trouble is indicated, and the status to prohibit a copying motion is initiated at the same time. When the shutters remain in an opened state in spite of the presence of a trouble, the status to allow a copying motion is retained while the presence of the trouble is displayed.

EXAMPLE 2

Now, another example of embodying the present invention will be described below.

In Example 1 described above, since the detection of a trouble is attained while the copying motion is in progress, the trouble in the copying motion can be infallibly detected and coped with. When the copying motion is interrupted, however, the sheet is left standing in the path of conveyance. The user of the copying machine of Example 1, therefore, is inevitably compelled to bear the burden of removing the stuck sheet. For the purpose of eliminating this problem of removal of the stuck sheet, Example 2 contemplates subjecting the shutters to diagnosis control before the start of the copying operation. Since the apparatus to be used in Example 2 is identical to that used in Example 1 above, the description of this apparatus will be omitted.

Figure 9:
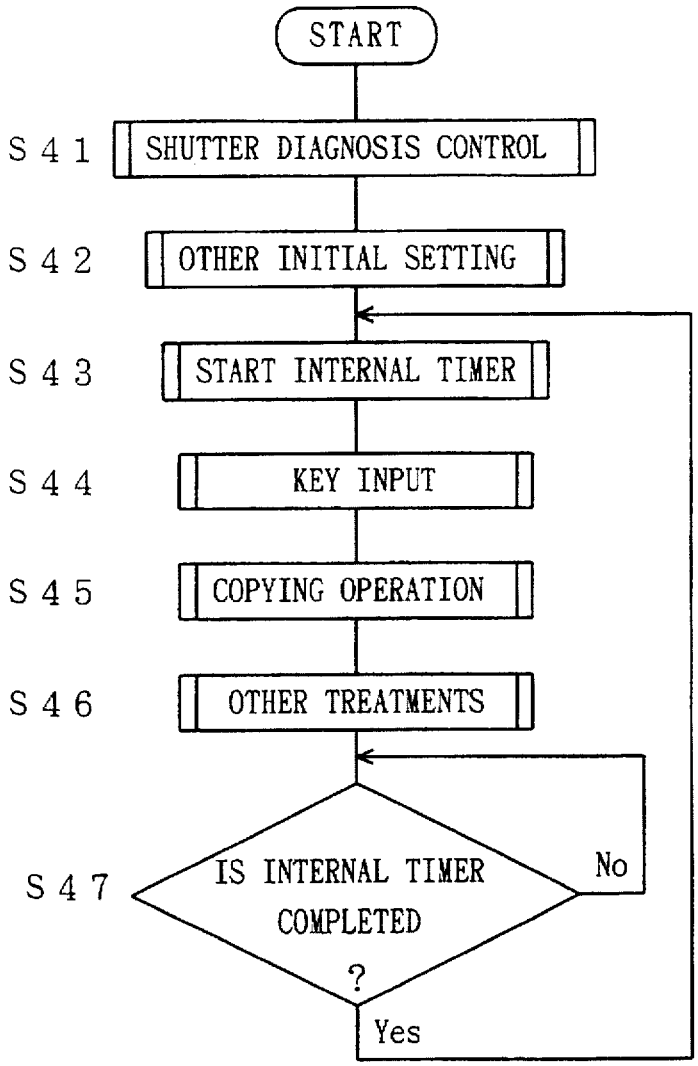
FIG. 9 is a flow chart of a main routine to aid in the description of the control in Example 2.

FIG. 9 is a flow chart of illustrating a main routine of the copying operation in Example 2. First, when the main switch (not shown) is depressed to connect the copying machine to the power source, Step S41 and Step S42 diagnoses a trouble, if any, of the machine and initializes the machine respectively.

Step S41 diagnoses a trouble in the shutters and effects due control in response to the outcome of the diagnosis as described specifically hereinbelow and Step S42 initializes various other contents of control of the copying machine.

Then, Step S43 starts the internal timer and implements the control of the steps from Step S44 onward within the length of time set by the internal timer.

Step S44 receives the information introduced by means of input keys on the operating panel 25 and displays necessary information on the display panel 22 on the operating panel 25. Step S45 controls a copying motion in accordance with the contents of control set at Step S44 mentioned above. Step S46 executes such other control than the control carried out by Step S45 as, for example, that for the adjustment of the temperature of the fixing device. Then, Step S47 judges whether or not the internal timer has terminated clocking. When this judgment draws an affirmative answer, the process returns to Step S43 and starts the internal timer again.

Figure 10:
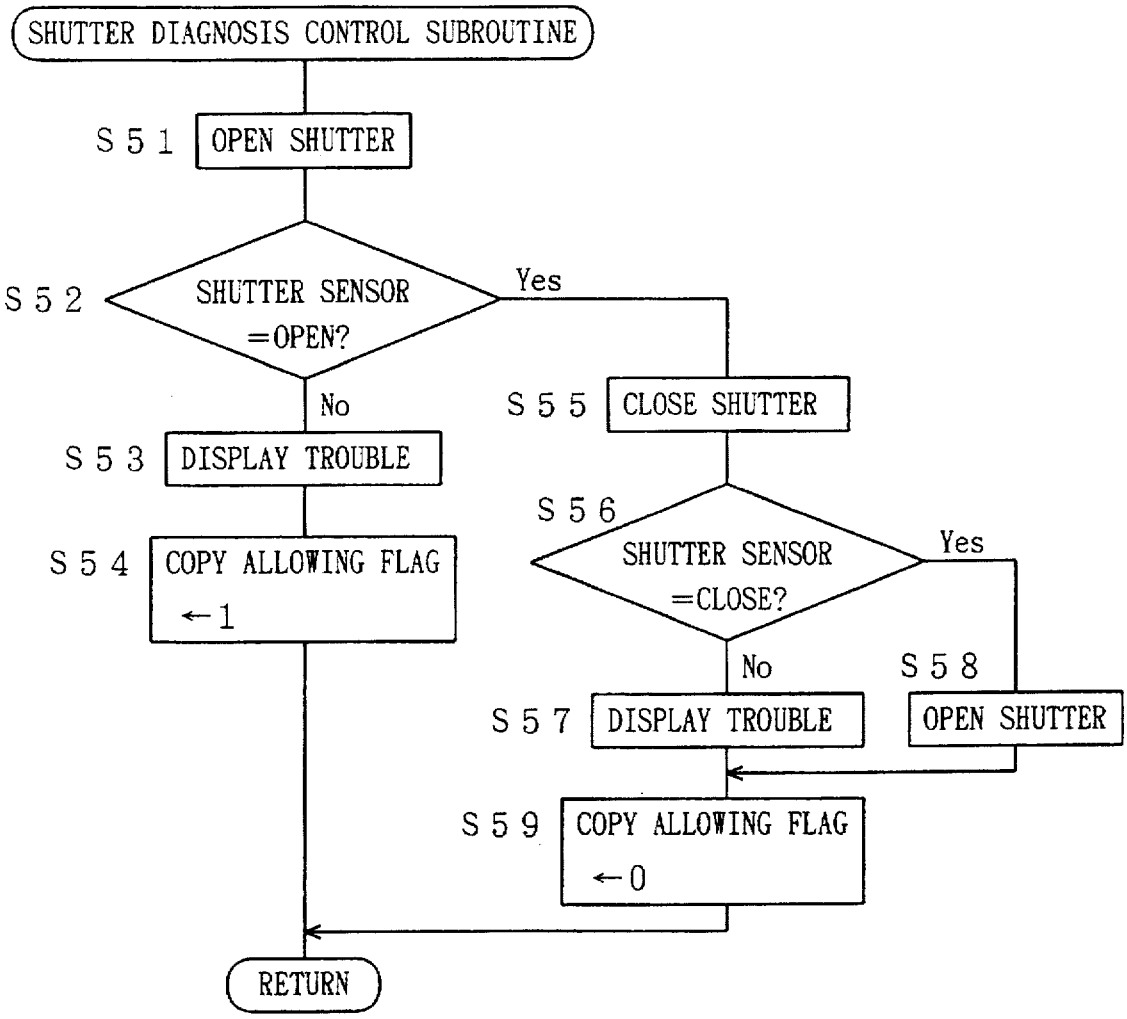
FIG. 10 is a flow chart of a shutter diagnosis control subroutine shown in FIG. 9 above.

FIG. 10 is a flow chart illustrating the procedure of control of the shutter diagnosis control subroutine effected by Step S41 mentioned above. In the present subroutine, the shutters are examined to diagnose a trouble, if any, before the start of the copying motion and controls the prohibition of the copying motion in conformity with the outcome of the diagnosis.

First, Step S51 forwards a signal to open the shutters to the solenoid 8. Next, Step S52, in response to the signal to open the shutters from Step S51, judges whether or not the shutters have been actually opened by the signal from the shutter state sensor 12. When the shutters are actually in an opened state, it judges that the shutters are not in trouble in response to the signal to open the shutters by step S51 and the steps from Step S55 onward are executed. In contrast, when the shutters are actually in a closed state, since the shutters are in trouble and are in a closed state and consequently the copying motion is not attainable, Step S53 displays the presence of a trouble on the display panel 22 and Step S54 sets the copy allowing flag at "1," namely the state of copy prohibition and returns the process to the main routine. By setting the copy allowing flag at "1," the copy status display lamp 21 displays copy prohibition and the status of prohibiting a copying motion is initiated.

At the steps from Step S55 onward, the operation for closing the shutters are examined to diagnose a trouble, if any, involved in the operation. First, Step S55 forwards a signal to close the shutters to the solenoid 8. Then, Step S56, in response to the signal to close the shutters issued at Step S55, judges whether or not the shutters have been actually closed by the signal from the shutter status sensor 12. When the shutters are found to be in a closed state, since no contradiction exists as to the motion of closing, Step S58 judges that no trouble has occurred and forwards a signal to open the shutters to the solenoid 8 and keeps the shutters open in preparation for the subsequent copying motion. In contrast, when the shutters are found to be in an opened state, since the signal to close the shutters contradicts the actual state of the shutters, Step S57 judges that the shutters are in trouble and displays the presence of trouble on the display panel 22 but does not prohibit the copying motion.

Then, Step S59 sets the copy allowing flag at "0" and returns the process to the main routine because the machine is either in a state of allowing a copying motion, namely the state of trouble in which the shutters are actually in an opened state in spite of the issuance of a signal to close the shutters, or in the normal state.

Figure 11:
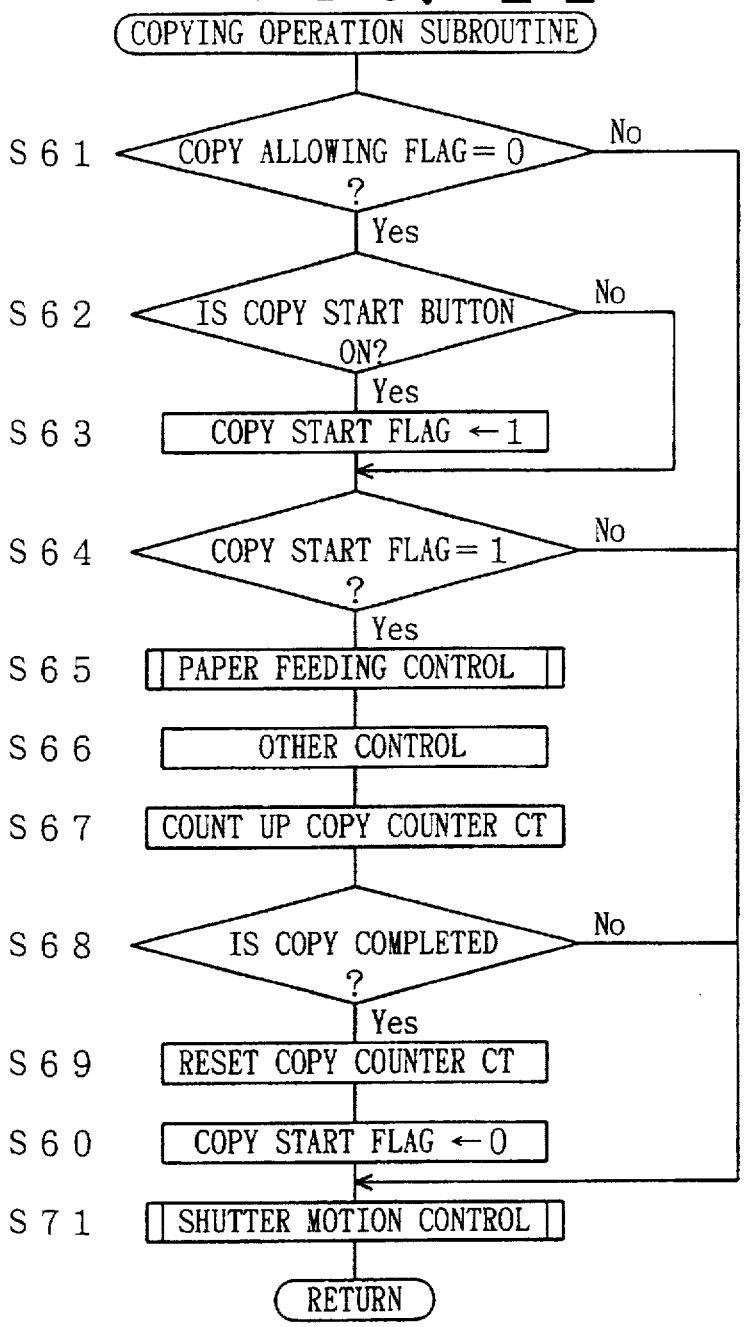
FIG. 11 is a flow chart of copying operation subroutine shown in FIG. 9 above.

FIG. 11 is a flow chart illustrating the procedure of control of the copying operation subroutine. First, Step S61 judges the state of the copy allowing flag and executes the steps from Step S62 onward when the state is found to be "0," namely the copy-allowed state. It returns the process to the main routine when the copy allowing flag is found to be "1," namely the copy-prohibited state.

Then, Step S62 judges whether or not the copy start button 20 has been turned ON. When the detection of ON edge is confirmed, Step S63 sets the copy start flag at "1." When the detection of ON edge is not confirmed, Step S63 is not executed but is advanced to Step S64.

Step S64 judges whether or not the copy start flag is set at "1." The steps from Step S65 onward are executed when the judgment draws an affirmative answer. The process is returned to the main routine when the judgment draws a negative answer.

Step S65 executes the control of the paper feeding and conveying system and Step S66 implements other controls such as, for example, the control of the image reading device and the photosensitive member.

Then, Step S67, after performing a copying motion, sets the copy counter CT taking count of sheets and causes the RAM 42 connected to the CPU 40 to memorize the accumulated number of copied sheets.

Step S68 compares the number counted up by the copy counter CT with the number set on the operating panel 25 to judge whether or not the copying motion has been terminated. Step S69 and Step S70 are omitted and Step S71 executes the control of shutter state and returns the process to the main routine when the copying motion has not been terminated. In contrast, when the copying motion has been terminated, Step S69 resets the copy counter CT and Step S70 sets the copy start flag at "0."

Then, Step S71 opens or closes the shutters based on the judgment of the copy start flag (FIG. 7) in the same manner as in Example 1 above and returns the process to the main routine.

The detection of a trouble of the shutters and the control effected to deal with the trouble in Example 2 have been described. Thus, the copying motion is prohibited and the presence of a trouble is displayed when the trouble in the shutters is detected before the start of the copying motion and the shutters are in a closed state after the issuance of a signal to open the shutters. The presence of a trouble is displayed and the state of allowing a copying motion is retained when the trouble in the shutters is detected before the start of the copying motion and the shutters are in an opened state after the issuance of a signal to close the shutters.

In both the two examples described above, the control of temperature of the fixing device to be initiated on detection of a trouble while the shutters are in an opened state may be alternatively fulfilled by a setting different from that which relies on the absence of a trouble.

The present invention can be embodied in a device which opens and closes the shutters each time an image is copied. The device otherwise may be so modified as to close airtightly the opening parts of the fixing device with shutters when the interior of such a device as, for example, the copying machine or the printer is opened for the sake of maintenance.

EXAMPLE 3

Yet another example embodying the present invention will be described below. In Example 3, the apparatus to be used therein is identical in mechanical construction with that of Example 1 mentioned above (FIGS. 1–3). Thus, the description of the apparatus will be omitted.

Figure 12:
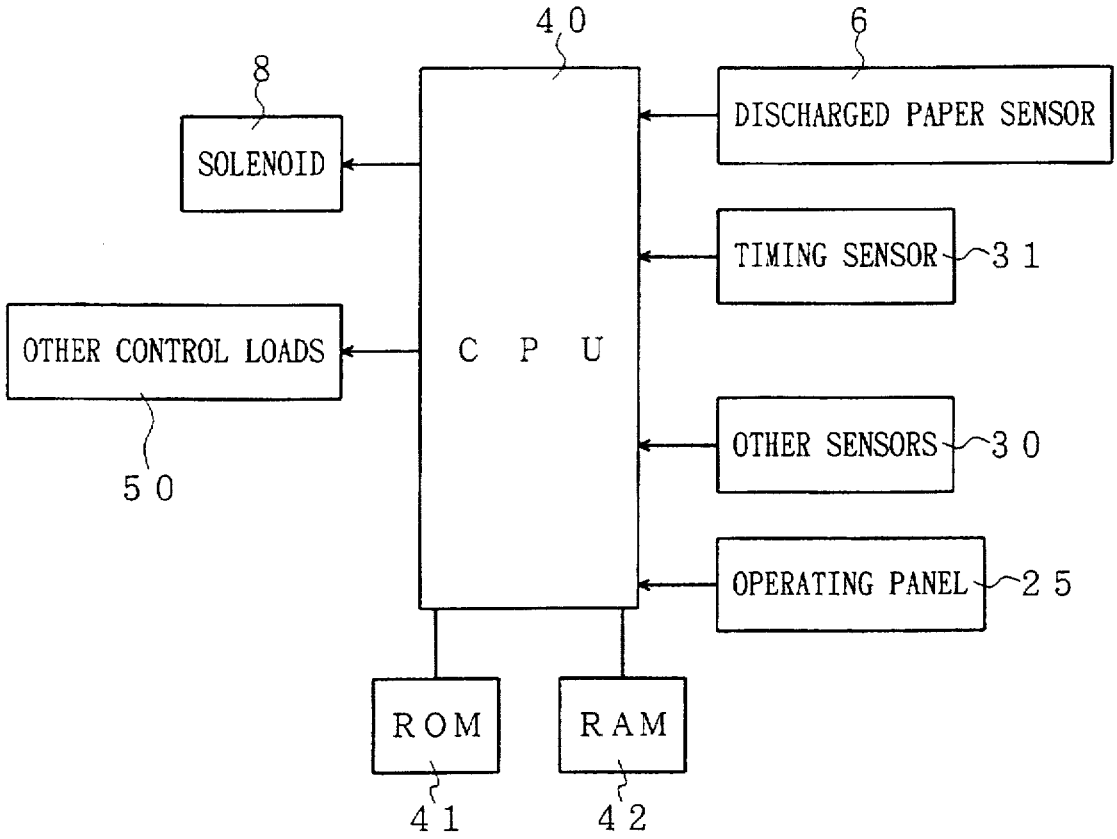
FIG. 12 is a block diagram of a control system of another mode for controlling the whole of the copying machine mentioned above.

FIG. 12 is a block diagram illustrating a control system for controlling the whole copying machine. The CPU 40 controls the whole copying machine and the RAM 42 for storing the information for control and the ROM 41 for memorizing a control program and control data are connected to the CPU 40. To the CPU 40 are introduced the detection signals from the discharged paper sensor 6, the timing sensor 31, and other sensors 30 (such as, for example, the shutter state sensor 12 and the temperature sensor 35) provided in the copying machine and the input signals from the input keys (such as, for example, the copy start button 20, ten key unit 23, and the function keys 24) on the operating panel 25 through the medium of input interfaces (not shown). From the CPU 40 are issued the signals for controlling the solenoid 8 for opening and closing the shutters and the control loads 50 in the copying machine (various components for the image forming operation such as, for example, the fixing device 18, the image reading device, the photosensitive member 16, and the rollers in the conveying path) through the medium of output interfaces (not shown). The CPU 40 has incorporated therein counters and timers for performing such counting treatments and clocking treatments as are utilized for the copying operation and the operation of opening and closing the shutters which will be described specifically hereinbelow.

Figure 13:
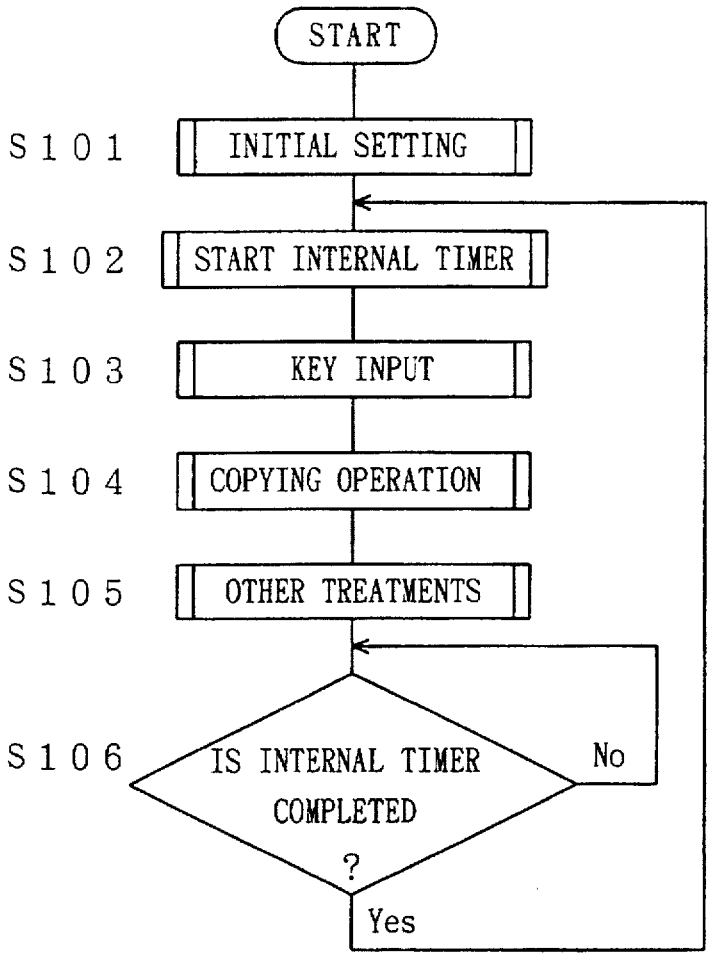
FIG. 13 is a flow chart of a main routine to aid in the description of the control in Example 3.

FIG. 13 is a flow chart illustrating the main routine of the operation of the copying machine.

First, when the main switch (not shown) is depressed to connect the copying machine to the power source, Step S101 initializes the contents of various controls performed on the copying machine. Step S102 starts the internal timer of the CPU 40 and the controls of the steps from Step S103 onward are carried out within the length of time set by the internal timer.

Step S103 receives the information introduced by means of the keys on the operating panel 25 and displays necessary information on the display panel 22 and the copy status display lamp 21 on the operating panel 25. Step S104 controls the copying motion in accordance with the contents of control set by Step S103 mentioned above. Step S105 implements such other control than the control executed by Step S104 mentioned above as, for example, that for the adjustment of temperature of the fixing device.

Step S106 judges whether or not the internal timer has terminated the process. When the judgment draws an affirmative answer, the process is returned to Step S102 which starts the internal timer again.

Figure 14:
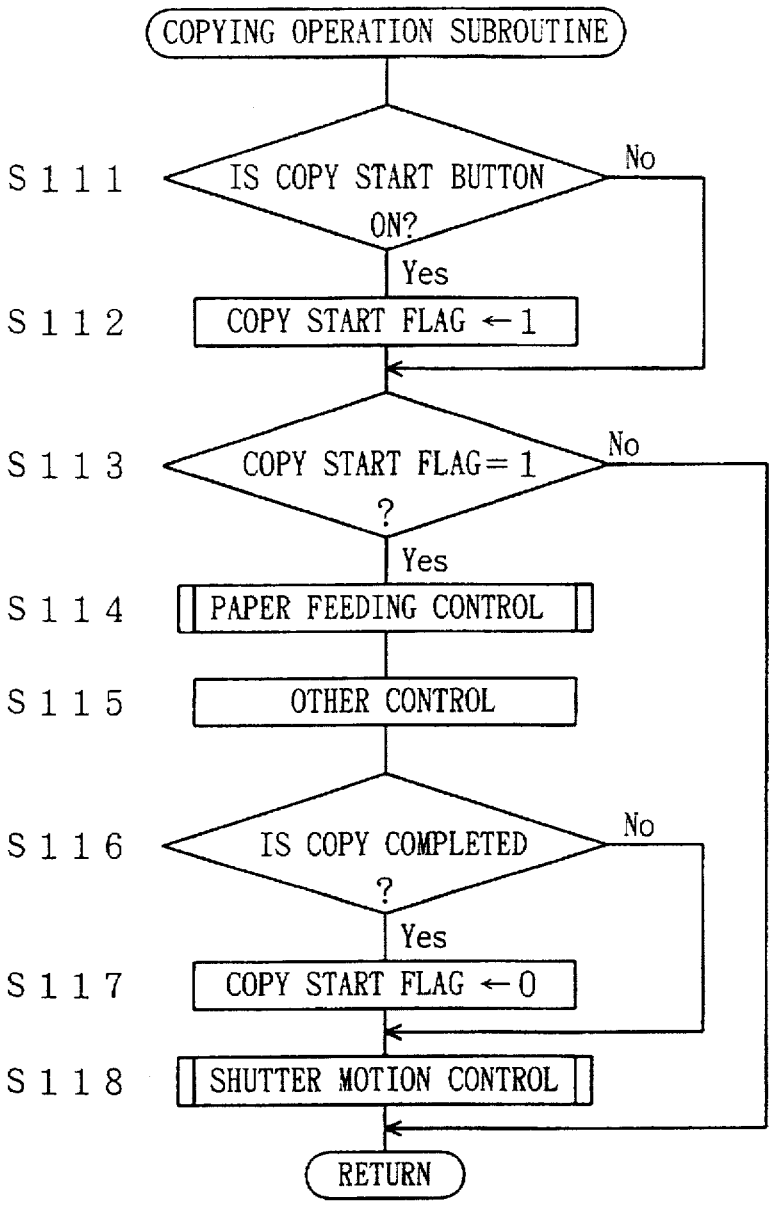
FIG. 14 is a flow chart illustrating the procedure of the copying operation subroutine in the main routine shown in FIG. 13.

FIG. 14 is a flow chart illustrating the procedure of control of the copying operation subroutine of Step S104 mentioned above. First, Step S111 judges whether or not the start button 20 has been turned ON. When the detection of ON edge is confirmed, Step S112 sets the copy start flag at "1." When the detection of ON edge is not confirmed, the process omits Step S112 and proceeds to Step S113.

Step S113 judges whether or not the copy start flag has been set at "1." The steps from Step S114 onward are executed when the judgment draws an affirmative answer. The process returns to the main routine when the judgment draws a negative answer.

Step S114 executes the control of the paper feeding and conveying system. Step S115 implements other control such as, for example, the control of the operations of the image reading device and the image forming device, namely the processes relating to the formation of a loose toner image on the sheet.

Step S116 compares the number of sheets counted up by the copy counter CT1 which will be specifically described hereinbelow with the number of sheets set on the operating panel 25 to judge whether or not the copying motion is proceeding on the last sheet. The process omits Step S117 and proceeds to Step S118 when the judgment draws a negative answer. Step S117 starts and sets the copy start flag at "0" and subsequently Step S118 executes the shutter motion control subroutine which will be described specifically hereinbelow and returns the process to the main routine when the judgment draws an affirmative answer.

Figure 15:
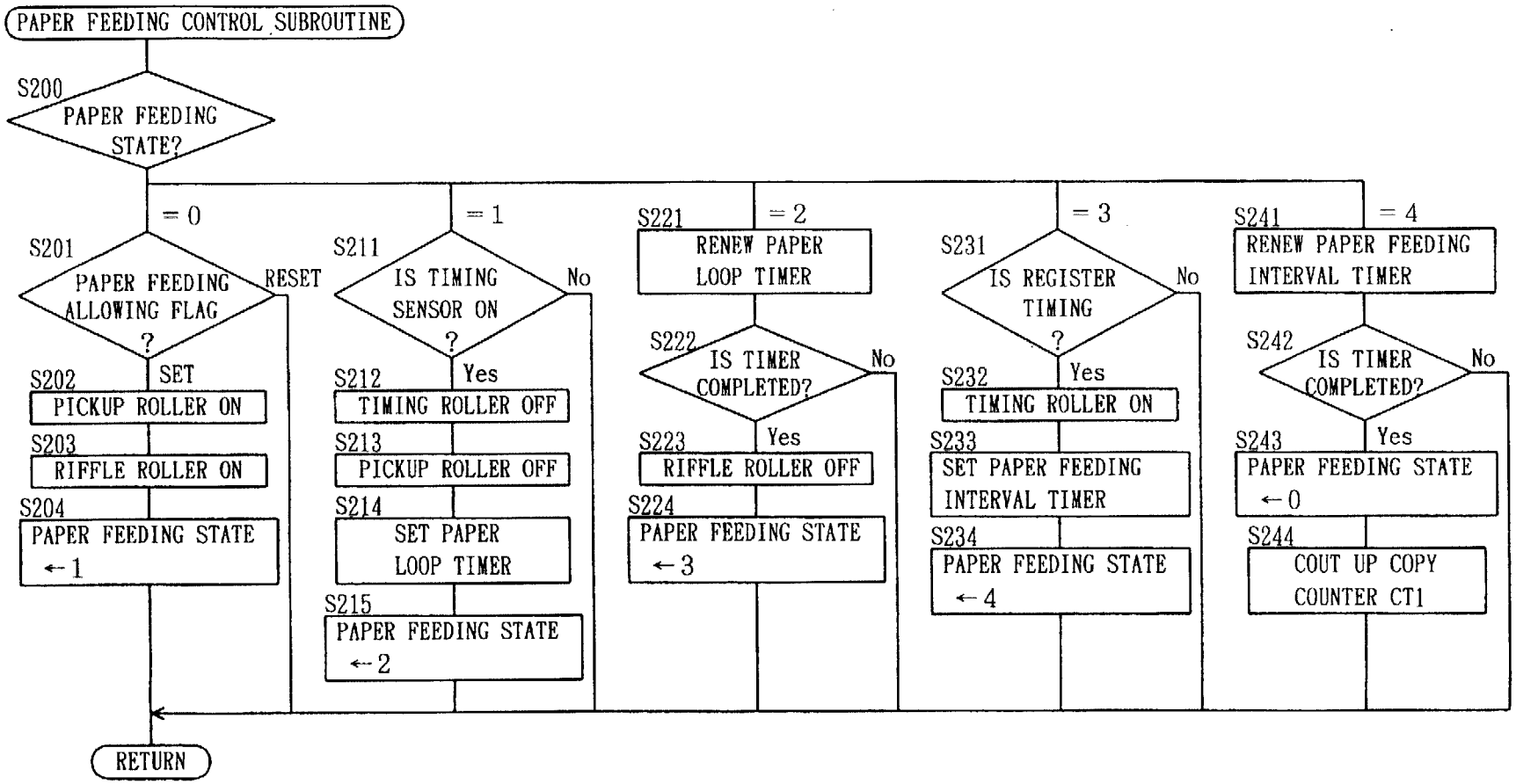
FIG. 15 is a flow chart illustrating the procedure of a paper feeding control subroutine in the copying operation subroutine shown in FIG. 14.

FIG. 15 is a flow chart illustrating the procedure of the paper feeding control subroutine of Step S114 mentioned above. In this routine, Step S200 checks the paper feeding state indicated by the numeral appearing in the state counter. The paper feeding state assumes "0" for its symbol at the initial state immediately after the power source connection and the waiting state immediately after the completion of a copying motion. The following treatments are attained by the change of the paper feeding state.

In the paper feeding state of "0", Step S201 checks the paper feeding allowing flag. The paper feeding allowing flag is set when the timer which initiates the motor and is used for starting and stabilizing the rotation as of the photosensitive member 16 for the sake of the image forming process completes clocking the time. It is reset in consequence of the completion of the discharge of the sheet. Other treatments than that by Step S202 are carried out while the paper feeding allowing flag remains in a set state. The process returns to the copying operation subroutine when the paper feeding allowing flag is reset.

Step S202 sets the pickup roller 13 rotating. Then, Step S203 set the riffle rollers 14 rotating to start the supply of a sheet from the cassette. Subsequently, Step S204 resets the paper feeding state to "1."

In the paper feeding state of "1," the ON-check for judging whether or not the timing sensor 31 is in an ON state, namely whether or not the sheet has been detected, is carried out. First, Step S211 judges whether or not the leading end of the sheet in motion from the paper feeding cassette has reached the position at which the timing sensor 31 is disposed. The process returns to the copying operation subroutine when the timing sensor 31 is not in an ON state, namely when the leading end of the sheet has not reached the position of the timing sensor 31. The steps from Step S212 through Step S215 are executed when the timing sensor 31 is in an ON state, namely when the leading end of the sheet has reached the position of the timing sensor 31.

Step S212 stops the rotation of the timing rollers 15 and Step S213 stops the rotation of the pickup roller 13. The riffle rollers 14 which has been set rotating previously continue to rotate. As a result, the sheet is curved to form a so-called paper loop at the entrance to the timing rollers 15 and allowed to correct its inclination relative to the direction of conveyance. Subsequently, Step S214 sets a paper loop timer for clocking the time required for the formation of a proper paper loop. Step S215 sets the paper feeding state at "2" and returns the process to the copying operation subroutine.

In the paper feeding state of "2," Step S221 renews the paper loop timer. As a result, the clocking by the paper loop timer advances each time one round of the main routine is executed. Then, Step S222 checks the paper loop timer and judges whether or not the count thereon has reached a prescribed numeral set by Step S214 mentioned above. The process returns to the copying operation subroutine when the judgment draws a negative answer. The steps from Step S223 onward are executed when the judgment draws an affirmative answer. Specifically, Step S223 stops the riffle rollers 14 and Step S224 resets the paper feeding state to "3."

In the paper feeding state of "3," Step S231 judges whether or not the register timing for defining the position of the toner image on the photosensitive member 16 relative to the position of the sheet has been reached. The process returns to the copying operation subroutine when the judgment draws a negative answer. Step S232 sets the timing rollers 15 rotating and starts the motion of the sheet to the position of transfer when the judgment draws an affirmative answer.

Subsequently, Step S233 sets a paper feeding interval timer for uniformly separating a plurality of sheets being continuously conveyed and Step S234 resets the paper feeding state to "4," and returns the process to the copying operation subroutine.

In the paper feeding state of "4," Step S241 renews the paper feeding interval timer. By the repetition of the paper feeding state of "4," Step S241 is executed such a number of rounds as is equivalent to the time set on the paper feeding interval timer. When Step S242 completes the operation of the paper feeding interval timer, Step S243 initializes the paper feeding state to "0" and Step S244 adds the number of fed sheets to the count on the copy counter CT so as to shift the paper feeding motion to the next sheet.

Figure 16:
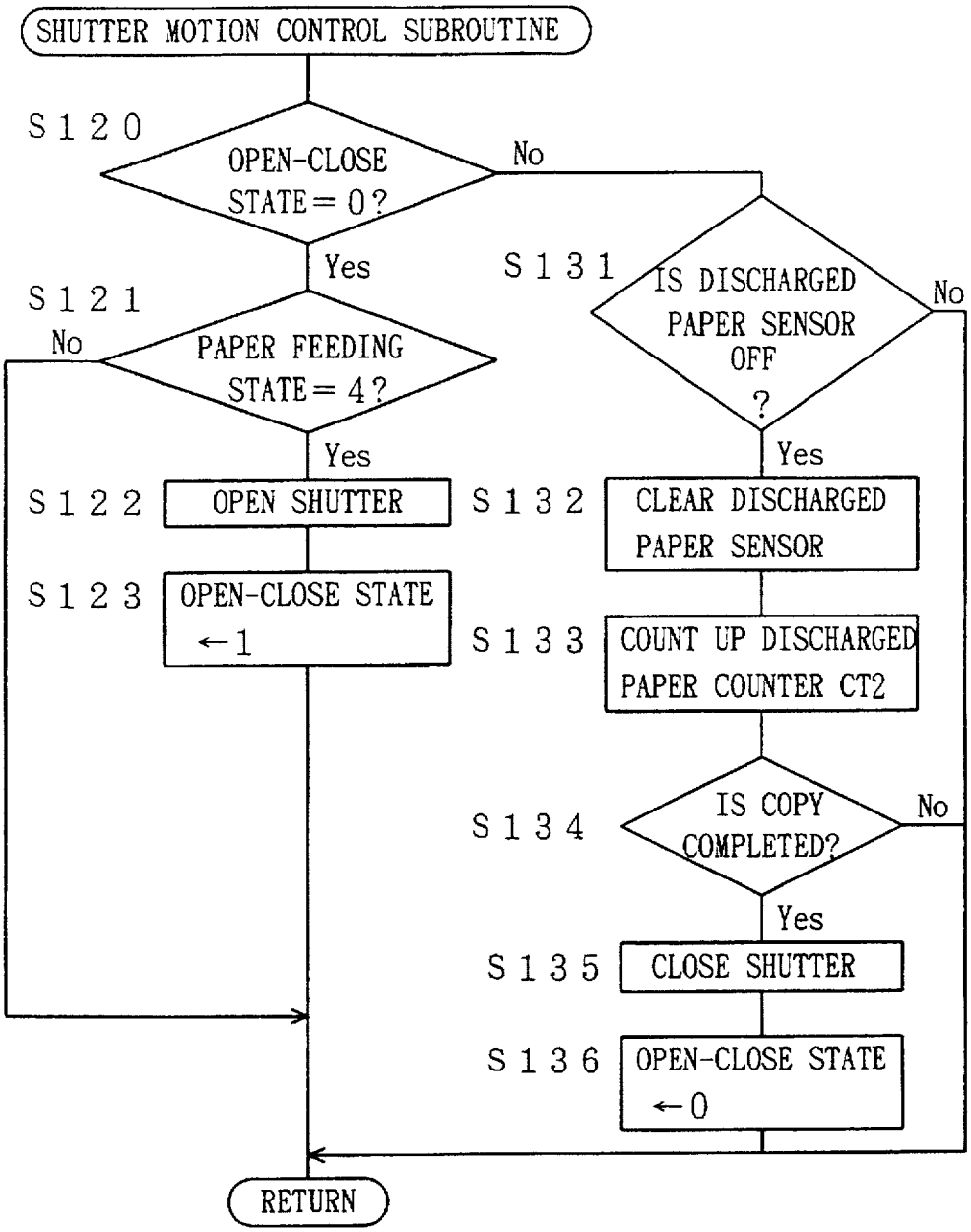
FIG. 16 is a flow chart showing the procedure of a shutter motion control subroutine in the copying operation subroutine shown in FIG. 14.

FIG. 16 is a flow chart illustrating the procedure of the control of the shutter motion control subroutine of Step S118 mentioned above. This subroutine effects the control such that the shutters may be opened at the timing for setting the timing roller 15 rotating and they may be closed when the last sheet passes the discharged paper sensor 6.

In the initial state immediately after the power source connection and the waiting state immediately after the completion of the copying motion, the open-close state is in the state of "0", namely in the state in which the shutters are closed. First, Step S120 judges whether the control is to be made for opening the shutters or for closing the shutters. When the open-close state is set at "0," the control is effected on the steps from Step S121 through Step S123 so as to effect the control for opening. When the open-close state is set at "1," the control is effected on the steps from Step S131 through Step S136 so as to effect the control for closing.

For the purpose of the control for opening, the state of operation of the paper feeding part in the control of the paper feeding treatment mentioned above is utilized. First, Step S121 makes use of the state of the flag of the paper feeding state as means for the detection of the ON state of the timing rollers 15. The process returns to the copying operation subroutine when the paper feeding state is set at other than "4," namely when the detection of the ON edge of the timing rollers 15 is absent. Step S122 turns the solenoid 8 on to open the shutters, then step S123 resets the open-close state at "1," and returns the process to the copying operation subroutine when the paper feeding state is set at "4," namely when the ON edge of the timing rollers 15 is detected.

For the purpose of the control for closing, Step S131 causes the discharged paper sensor 6 to detect the OFF edge of the discharge of the sheet. In the absence of this detection, the process is returned to the copying operation subroutine and the routine is repeated until the discharge of the sheet is detected. In the presence of the detection, Step S132 clears the discharged paper sensor 6 in preparation for the discharge of the next sheet and Step S133 adds the number of discharged sheets to the discharged paper counter CT2. Subsequently, Step S134 compares accumulated count appearing in the discharged paper counter CT2 with the number of sheets set on the operating panel 25 to judge whether or not the discharged sheet is the last of the plurality of sheets. When the copying motion has not been completed, Step S135 and Step S136 are not executed and the process is returned to the copying operation subroutine. When the copying motion has been completed, Step S135 turns off the solenoid 8 to close the shutters, Step S136 resets the open-close state to "0," and the process returns to the copying operation subroutine.

The contents of the control which are effected in Example 3 for opening the shutters by the timing for setting the timing rollers 15 rotating and closing the shutters by utilizing the passage of the last of a plurality of sheet through the discharged paper sensor 6 have been described. The opening-closing motion which, in the continuous copying of an image or images on a plurality of sheets, prevents the shutters from producing opening-closing operations between the time the copying machine forms an image and the time it discharges the last of the plurality of sheets while minimizing the time during which the shutters remain open can be realized.

EXAMPLE 4

Now, still another example of embodying this invention will be described below. In Example 4, the apparatus to be used therein is identical in mechanical construction to that of Example 1 mentioned above and in the construction of the control system to that of Example 3 mentioned above. In the copying operation to be involved in Example 4, the procedure of the main routine is identical to that illustrated in FIG. 13, the procedure of the copying operation subroutine to that illustrated in FIG. 14, and the procedure of the paper feeding control subroutine to that illustrated in FIG. 15 respectively of Example 3 mentioned above. These procedures, therefore, will be omitted from the following description. Thus, the description will be limited to the operation for the control of the opening-closing motion of the shutters.

Figure 17:
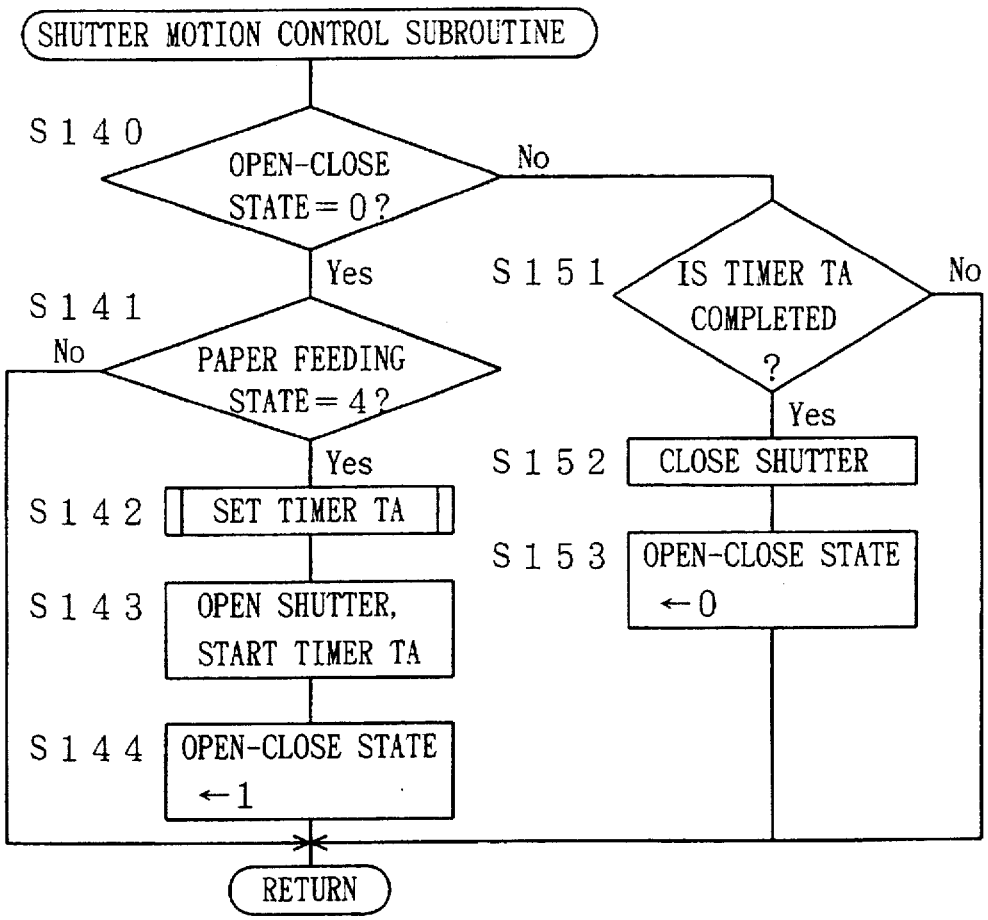
FIG. 17 is a flow chart illustrating a shutter motion control subroutine of Example 4 in the copying operation subroutine shown in FIG. 14.

FIG. 17 illustrates the procedure of the control for opening and closing shutters in Example 4. This procedure constitutes itself a subroutine of Step S118 shown in FIG. 14.

This shutter motion control proceeds so that the shutters may be opened based on the ON timing of the timing rollers 15 and they may be closed based on the detection of the timing of discharge of the last of a plurality of sheets obtainable by clocking the time elapsing after the shutters are opened.

First, Step S140 judges whether the control for opening the shutters or the control for closing the shutters is to be made. When the open-close state is set at "0," the control is effected on the steps from Step S141 through Step S144 to open the shutters. When the open-close state is set at "1," the control is effected on the steps from Step S151 through Step S153 to close the shutters.

For the purpose of the control for opening the shutters, Step S141 judges whether or not the paper feeding state as means for the detection of the ON status of the timing rollers 15 is set at "4." The process returns to the copying operation subroutine when the paper feeding state is set at other than "4," namely in the absence of the detection of the ON edge of the timing rollers 15. Step S142 sets as the numeral on the timer TA the time required for the last of a plurality of sheets to be discharged from the fixing device 18 after the shutters are opened when the paper feeding state is set at "4," namely in the presence of the detection of the ON edge of the timing rollers 15. Then, Step S143 turns on the solenoid 8 to open the shutters and, at the same time, starts the timer TA set by Step S142 mentioned above. Thereafter, Step S144 resets the open-close state at "1" and returns the process to the copying operation subroutine.

For the purpose of the control for closing the shutters, Step S151 detects the completion of the timer TA set by Step S142 mentioned above. The process is returned to the copying operation subroutine in the absence of the detection and this routine is repeated until the completion of the timer TA is detected. In the presence of the detection, Step S152 turns off the solenoid 8 to close the shutters, Step S153 returns the open-close state to "0," and the process is returned to the copying operation subroutine.

Figure 18:
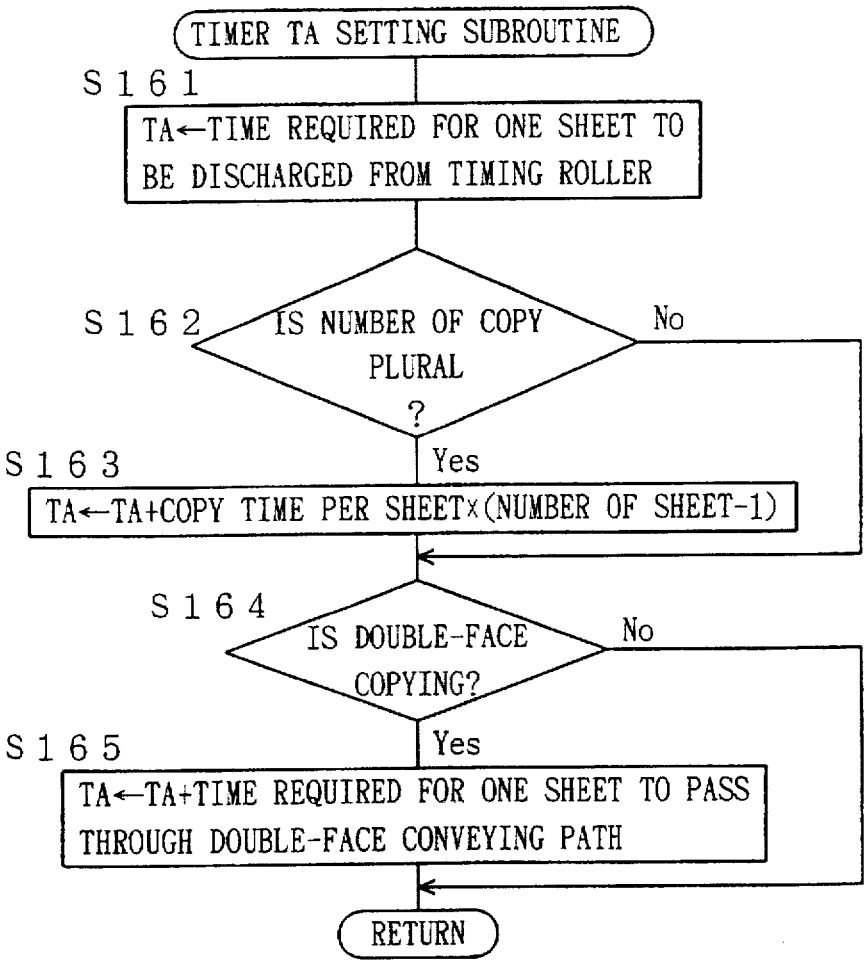
FIG. 18 is a flow chart illustrating the procedure of a timer TA setting subroutine in the shutter motion control subroutine shown in FIG. 17.

FIG. 18 is a flow chart illustrating the subroutine of the procedure of the control for setting the numeral on the timer TA by Step S142 mentioned above.

First, Step S161 sets for the numeral on the timer TA the time required for opening the shutters when the number of sheet to be used for copying is one. Specifically, the interval between the time the leading end of the one sheet begins to move from the timing rollers 15 to the area of transfer and the time the trailing end of the sheet being discharged departs from the fixing device 18 is set as the numeral.

Then, Step S162 judges whether or not the number of sheets for copying is plural based on the information of the number of copies introduced through the operating panel 25. The process omits Step S163 and advances to Step S164 when the number of sheet for copying is one.

When the number of sheets for copying is plural, Step S163 adds to the numeral on the timer TA a relevant excess of time than the time set by Step S161 mentioned above and advances the process to Step S164. Specifically, the product of the copying time required per sheet by the copying machine in use multiplied by the number of copies being used minus one is used for this addition.

Then, Step S164 judges whether or not the sheet is used for double-face copying. The process omits Step S165 and returns to the shutter motion control subroutine when the judgment draws a negative answer. When the judgment draws an affirmative answer indicating the double-face copying, the process adds to the numeral on the counter TA a relevant excess of time than the time set by Step S163 or Step S161 mentioned above and then returns to the shutter motion control subroutine. Specifically, the product of the time required for the sheet to pass through the path 32 for the doubleface copying conveyance (including the time spent at the inverting device 33) multiplied by the number of passages of sheets through the path 32 for conveyance is used for the addition.

The contents of the control which are effected in Example 4 for opening the shutters based on the ON timing of the timing rollers 15 and closing the shutters based on the detection of the timing for discharge of the last of a plurality of sheets obtainable by clocking the time elapsing after the shutters are opened have been described.

The embodiment described in Example 4 can minimize the time for opening the shutters because the open-close state of the shutters is controlled by the timer with the ON edge of the timing rollers 15 as the starting point.

In Example 4, the timing for opening the shutters is based on the detection of the operation of the timing rollers 15, namely the judgment on the question whether or not the paper feeding state is set at "4." Alternatively, this timing may be based on the detection of the paper feeding state which is set at other than "0." When the paper feeding state is set at "1," for example, the detection of the ON edge of the pickup roller 13 may form a basis for the timing.

EXAMPLE 5

Now, a further example embodying the present invention will be described below. In Example 5, the apparatus to be used therein is identical in mechanical construction to that of Example 1 mentioned above. In the copying operation to be involved in Example 4, the procedure of the main routine is identical to that illustrated in FIG. 13, the procedure of the copying operation subroutine to that illustrated in FIG. 14, and the procedure of the paper feeding control subroutine to that illustrated in FIG. 15 respectively of Example 3 mentioned above. These procedures, therefore, will be omitted from the following description. Thus, the description will be limited to the operation for the control of the opening-closing motion of the shutters.

Figure 19:
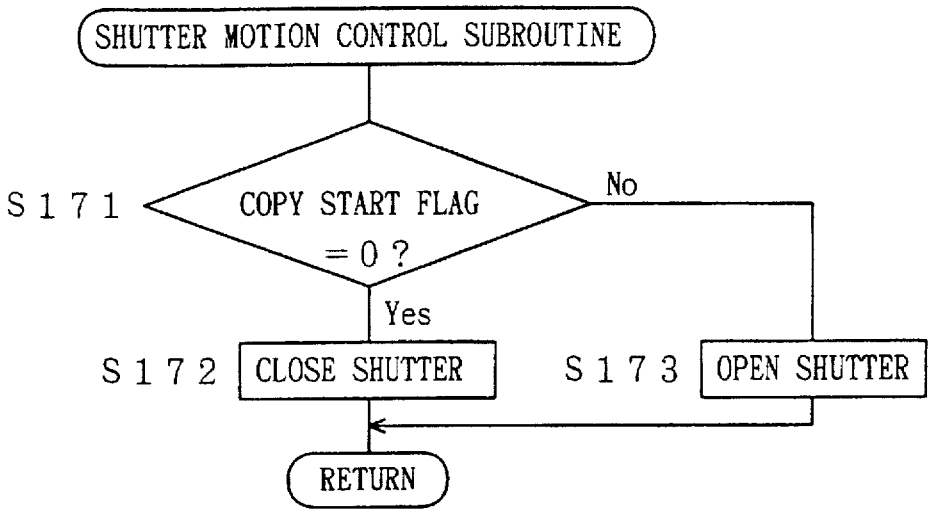
FIG. 19 is a flow chart illustrating the control of Example 5 in a shutter motion control subroutine in the copying operation subroutine shown in FIG. 14.

FIG. 19 is a flow chart illustrating the procedure of the shutter motion control in Example 5. This procedure forms a subroutine of Step S118 shown in FIG. 14.

In Example 5, the control is effected so that the shutters may be opened by detecting the start of a series of copying motions in the light of the ON edge of a copy start flag and they may be closed by detecting the completion of the series of copying motions inclusive of the case of using a plurality of sheets for copying in the light of the ON edge of the copy start flag.

First, in the initial state immediately after the power source connection and the waiting state immediately after the completion of the copying operation, the copy start flag is set at "0," namely the depression of the copy start button 20 for starting the copying operation is awaited. When the copy start button 20 is turned on by depression in the state just mentioned, the control is effected on the steps, Step S111 and Step S112, shown in FIG. 14 as already described. Consequently, the copy start flag is set at "1," the subsequent steps are sequentially executed, and the shutter motion control subroutine is put to operation.

First, Step S171 judges whether or not the copy start flag is set at "0." When the copy start flag set at "1" is detected, Step S173 turns on the solenoid 8 to open the shutters and returns the process to the copying operation subroutine.

When the copy start flag in the copying operation subroutine is returned to "0" by the time that all the sheets have been used for copying (by Step S117 of FIG. 14) and, consequently, Step S171 detects the copy start flag to be set at "0," Step S172 subsequently turns off the solenoid 8 to close the shutters and returns the process to the copying operation subroutine.

The contents of the control which are effected in Example 5 for opening the shutters by detecting the ON edge of the copy start flag as means for the detection of the start of a series of copying motions and closing the shutters by detecting the OFF edge of the copy start flag as means for the detection of the completion of the series of copying motions have been described. In Example 5, the shutters can be infallibly opened and closed by the simplest control described above where no very exact limit is imposed on thermal insulation.

Figure 20:
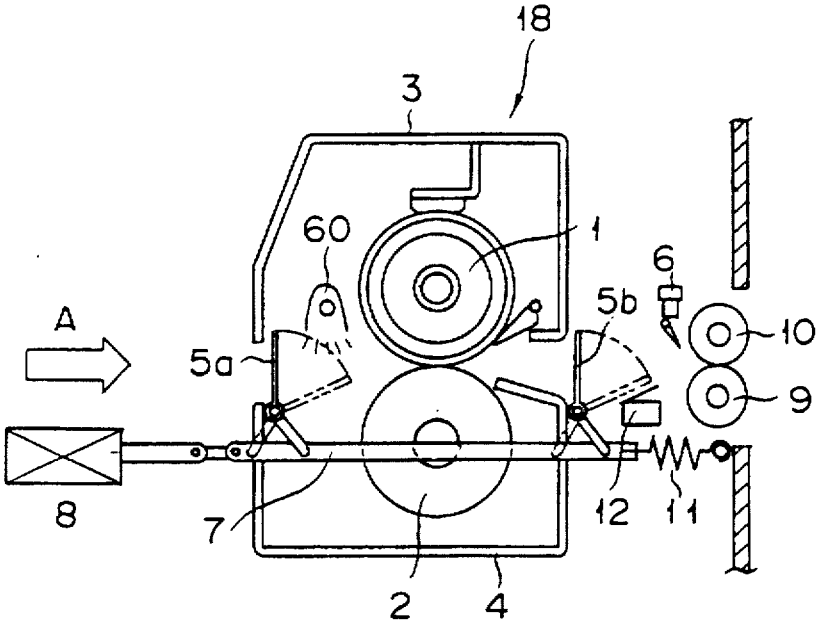
FIG. 20 is a schematic diagram of a fixing device of another mode of embodying this invention.
Figure 21:
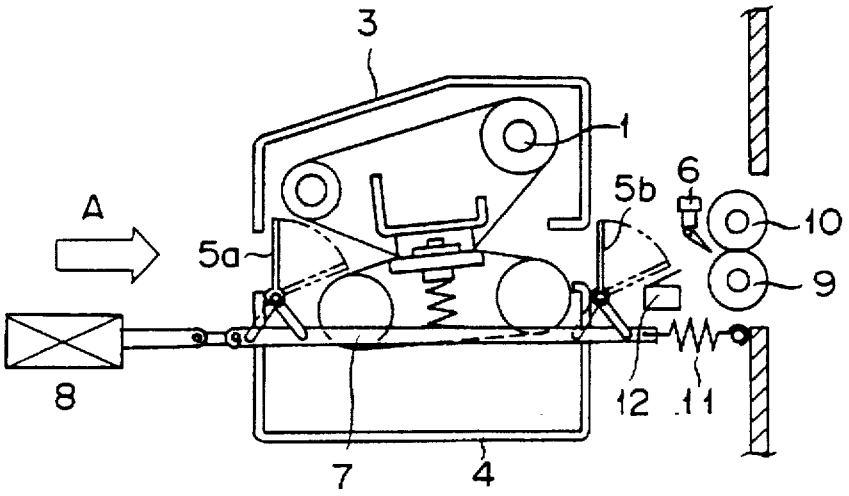
FIG. 21 is a schematic diagram of a fixing device of yet another mode of embodying this invention.

Though all the examples cited above have been described as embodied in the heat roller type fixing device 18, this invention does not need to be limited to this particular embodiment. The present invention alternatively may be embodied in a fixing device which is provided with such a preheating lamp 60 as is illustrated in FIG. 20 or in such a belt type fixing device as is illustrated in FIG. 21, for example. While the examples have been described as utilized in the copying machine, the image forming apparatus contemplated by this invention may be a printer or a facsimile system instead of the copying machine as a matter of course.

The entire disclosure of each of Japanese Patent Application No. 8-032083 filed on Feb. 20, 1996 and Japanese Patent Application No. 8-072802 filed on Mar. 27, 1996 including specification, claims, drawings and summary are incorporated herein by reference in its entirety.

What is claimed is:

1. An image forming apparatus provided with a fixing device for fixing an image formed on a sheet, which apparatus comprises:

shutters which shield opening parts formed in said fixing device for the passage of said sheet;

a driver which switches said shutters between the opened state and the closed state;

a sensor which detects the presence or absence of the opened state of said shutters;

control means for setting said driver moving and controlling the opening or closing motion of said shutters; and prohibiting means for comparing the signal from said control means and the signal from said sensor and prohibiting said fixing device from producing a fixing motion when said sensor detects the closed state of said shutters notwithstanding said control means has issued a signal to open said shutters.

2. An image forming apparatus according to claim 1, wherein said prohibiting means operates in response to a signal to start an image forming operation.

3. An image forming apparatus according to claim 1, wherein said prohibiting means is put to operation when the supply of electric power to said fixing device is started.

4. An image forming apparatus according to claim 1, wherein said prohibiting means stops an image forming operation when said sensor detects the closed state of said shutters after said control means has issued a signal to open said shutters.

5. An image forming apparatus according to claim 4, which further comprises a display capable of enabling said prohibiting means to display abnormality thereon when said sensor detects the opened state of said shutters after said control means has issued a signal to close said shutters.

6. A fixing device comprising:

shutters which shield opening parts formed in said fixing device for the passage of a sheet;

a driver which switches said shutters between the opened state and the closed state;

a sensor which detects the presence or absence of the opened state of said shutters;

control means for setting said driver moving and controlling the opening or closing motion of said shutters; and fixing motion controlling means for comparing the signal from said control means and the signal from said sensor and prohibiting start of a fixing motion of said fixing device when said sensor detects the closed state of said shutters notwithstanding said control means has issued a signal to open said shutters and, in contrast, allowing the start of the fixing motion of said fixing device when said sensor detects the opened state of said shutters notwithstanding said control means has issued a signal to close said shutters.

7. A fixing device according to claim 6, which further comprises a display capable of enabling said fixing motion controlling means to display abnormality thereon when said sensor detects the opened state of said shutters after said control means has issued a signal to close said shutters.

8. An image forming apparatus provided with a fixing device for fixing an image formed on a sheet, which apparatus comprises:

shutters which shield opening parts formed in said fixing device for the passage of said sheet;

a driver which switches said shutters between the opened state and the closed state;

a sensor which detects the presence or absence of the opened state of said shutters; and control means for setting said driver moving and controlling the opening or closing motion of said shutters, said control means effecting the control of said shutters during continuous formation of an image on a plurality of sheets in such a manner that said shutters may be kept open between the time the first sheet is passed therethrough and the time the last sheet is discharged therefrom.

9. An image forming apparatus according to claim 8, which further comprises conveying means for conveying said sheet and a sensor which is disposed on the downstream side of said fixing device in the direction of conveyance of said sheet whereby said control means opens said shutters when the conveying motion of said conveying means is started and closes said shutters when said sensor detects the trailing end of said sheet.

10. An image forming apparatus according to claim 8, which further comprises conveying means for conveying said sheet and a timer which counts a prescribed time after the start of a conveying motion of said conveying means whereby said control means opens said shutters when said conveying motion is started and closes said shutters when said timer has counted up said prescribed time.

11. An image forming apparatus according to claim 8, wherein said control means opens said shutters when the image forming operation is started and closes said shutters when said image forming operation is completed on the last of the plurality of sheets.

12. An image forming apparatus provided with a fixing device for fixing an image formed on a sheet, which apparatus comprises:

shutters which shield opening parts formed in said fixing device for the passage of said sheet;

a driver which switches said shutters between the opened state and the closed state;

a sensor which detects the presence or absence of the opened state of said shutters;

conveying means for conveying said sheet;

a counter which takes count of the number of sheets conveyed by said conveying means;

setting means for setting the number of sheets on which the image is expected to be formed; and control means for setting said driver operating and controlling the opening and closing motions of said shutters, said control means effecting the control of said driver during the continuous formation of an image on a plurality of sheets in such a manner that said shutters may be opened when the image forming operation is started and the shutters may be closed after said counter has counted up the preset number of sheets.

* * * * *